US006401614B1

(12) United States Patent
Venturati

(10) Patent No.: US 6,401,614 B1
(45) Date of Patent: Jun. 11, 2002

(54) PROCESS FOR PREPARING REMOVABLE METAL SLEEVES FOR PRINTING MACHINES

(75) Inventor: Laura Teresa Venturati, Rho (IT)

(73) Assignee: Rotoincisa S.R.L., Milano (IT)

( * ) Notice: Subject to any disclaimer, the term of this patent is extended or adjusted under 35 U.S.C. 154(b) by 0 days.

(21) Appl. No.: 09/637,258

(22) Filed: Aug. 11, 2000

Related U.S. Application Data

(63) Continuation-in-part of application No. 09/117,727, filed on Aug. 5, 1998, now Pat. No. 6,158,340.

(30) Foreign Application Priority Data

Mar. 14, 1996 (IT) ..... MI96A0492

(51) Int. Cl.[7] ..... B41C 1/18; B41N 1/06

(52) U.S. Cl. ..... 101/375; 101/153; 101/170; 492/54; 205/73

(58) Field of Search ..... 101/150, 153, 101/170, 375, 401.1; 492/48, 54, 57, 58; 204/212; 205/69, 70, 73, 127

(56) References Cited

U.S. PATENT DOCUMENTS

| | | | | | |
|---|---|---|---|---|---|
| 3,923,610 | A | * | 12/1975 | Bergin et al. | 101/170 |
| 3,927,463 | A | * | 12/1975 | Dupree et al. | 204/216 |
| 3,947,330 | A | * | 3/1976 | Heidenberger | 205/127 |
| 3,960,675 | A | * | 6/1976 | Motter | 205/127 |
| 4,151,064 | A | * | 4/1979 | Kuehnle | 204/298 |
| 4,197,798 | A | * | 4/1980 | Bardin | 101/153 |
| 4,556,610 | A | * | 12/1985 | Van Heuvelen | 101/153 |
| 4,812,219 | A | * | 3/1989 | Sattrup et al. | 101/375 |
| 5,168,808 | A | * | 12/1992 | Prem | 101/375 |
| 5,247,884 | A | * | 9/1993 | Rid | 101/375 |
| 5,318,683 | A | * | 6/1994 | Smith et al. | 204/252 |
| 5,974,972 | A | * | 11/1999 | Van Denend et al. | 101/375 |

FOREIGN PATENT DOCUMENTS

| | | | | |
|---|---|---|---|---|
| DE | 3042490 | * | 6/1982 | 101/170 |
| DE | 3138164 | * | 4/1983 | 101/170 |
| EP | 9360 | * | 4/1980 | |
| WO | 87-03843 | * | 7/1987 | |
| WO | 94-27831 | * | 12/1994 | |

* cited by examiner

*Primary Examiner*—Stephen R. Funk
(74) *Attorney, Agent, or Firm*—Michael J. Striker

(57) ABSTRACT

It is disclosed a process for preparing a removable sleeve to be photoengraved, for use in printing presses, which sleeve is obtained by immersion of a cylinder in a copper-electroplating tank to generate the sleeve itself, and separation of the cylinder is obtained either by an extraction tooling or with use of a metal ring for closure of the holes for air admission, which are designed to create an air cushion enabling easy removal.

15 Claims, 5 Drawing Sheets

PROCESS FOR PREPARING REMOVABLE METAL SLEEVES FOR PRINTING MACHINES

CROSS REFERENCE TO RELATED APPLICATION

This application is a continuation in part of applicant's application Ser. No 09/117,727 filed Aug. 5, 1998, now U.S. Pat. No. 6,158,340.

FIELD AND BACKGROUND OF THE INVENTION

The present invention relates to a process for preparing removable sleeves to be photoengraved for use in printing presses.

The invention in particular relates to metal sleeves to be used in rotogravure and/or flexographic printing.

It is known that rotogravure printing takes advantage of a cylindrical printing form giving rise to the desired images, which form is obtained by a photoengraving process creating small cells inside which ink is retained to be then transferred to the paper.

The surface on which the cells are engraved following the different methods, i.e. the traditional, halftone, conversion, electronic and still other methods, is generally made of copper.

This surface is obtained by electroplating on iron cylinders and after photoengraving it is submitted to a protection chromium-plating process.

At each new series of images, the cylinders are processed in qualified engraver's shops and then sent to the user for mounting on rotogravure printing presses.

Taking into account the important sizes and weight of each cylinder and at the same time the great fragility of the engraved surfaces or the surfaces to be engraved, clear problems exist for transportation and storage, which will bring about heavy costs and consequent locking up of capital.

In order to overcome the above drawbacks and reduce costs, use of cylindrical metal sleeves generally of nickel, to be removed from the cylinders, has been envisaged.

A copper coating is deposited on the surfaces of these sleeves, which is similar to the coating deposited on the surfaces of traditional cylinders, in order to enable a normal photoengraving.

To facilitate removal of these sleeves from the cylinders different methods have been adopted. The most famous method comprises a series of holes opening onto the surface of the cylinder and enabling creation of a compressed air cushion between the cylinder surface and the sleeve.

Taking into account the great difference in weight between the sleeves, 2–3 kilograms, and the cylinder, a 100–200 kilograms, the great advantages offered by the removable sleeves over the traditional cylinders appear obvious. Management costs are reduced due to the elimination of grinding and balancing operations, servicing, costs for staff and transportation. The print quality is improved without formation of grinding imprecisions or expensive waste.

However, taking into account the present situation on the market tending to a greater variability in wraps with a reduction in press-runs, where there is also a need for a further reduction in costs so as to increase competitiveness, elimination of the sleeves after a press-run has been completed is still-heavy and capable of adversely affecting the market.

Consequently, a process has been adopted in which a copper coating is formed on the sleeves made of nickel in such a manner that detachment of the film when the engraving is to be replaced is made easy.

According to a preferred method, a copper film is applied to the sleeves made of nickel together with a separation product, then formation of the copper coating to be photoengraved is carried out.

Then, on the copper-plated nickel sleeve, once the coating has been removed, a new coating for a new engraving is deposited by electroplating.

The separation product generally consists of a silver-based solution or of passivation agents such as chromates, dichromates or others.

Separation of this copper coating from the sleeve, when a new photoengraving is to be carried out, is obtained with the aid of mechanical means. Then, after application of the separation product, a new coating is deposited.

This process has important advantages as compared with a direct deposition of the coating to be photoengraved onto the cylinder.

However, cost of the sleeves is still very high due both to the high cost of nickel and to the long times required for formation of the different layers: the copper film, the separation product, the copper coating.

SUMMARY OF THE INVENTION

It is an object of the present invention to provide a process for making sleeves to be photoengraved for rotogravure and/or flexographic printing, capable of enabling production of the sleeves directly in a galvanic bath without use of any nickel sleeve on which copper is to be electroplated.

It is a further object of the invention to enable accomplishment of sleeves, preferably completely made of copper, which can be easily removed from the cylinder on which they are produced and at the same time can ensure an optimal observance of the required tolerances in particular for rotogravure printing.

A still further object of the invention is to greatly reduce costs for the removable sleeves, as regards both the material and the time required for forming them, which therefore will bring about important advantages both from an economical and from a practical point of view, as clarified in the following.

The foregoing and further objects that will become more apparent in the course of the present description are substantially achieved by a process for preparing removable metal sleeves to be photoengraved for printing machines as claimed in one or more of the accompanying claims.

A detailed description of a preferred but not exclusive method of preparing removable metal sleeves for rotogravure and/or flexographic printing is now given hereinafter.

BRIEF DESCRIPTION OF THE DRAWINGS

The features and aims of the invention will become still more apparent from the following examples embodying the invention and accompanied by diagrammatic drawings, in which.

DESCRIPTION OF THE PREFERRED EMBODIMENT

Figure 1:
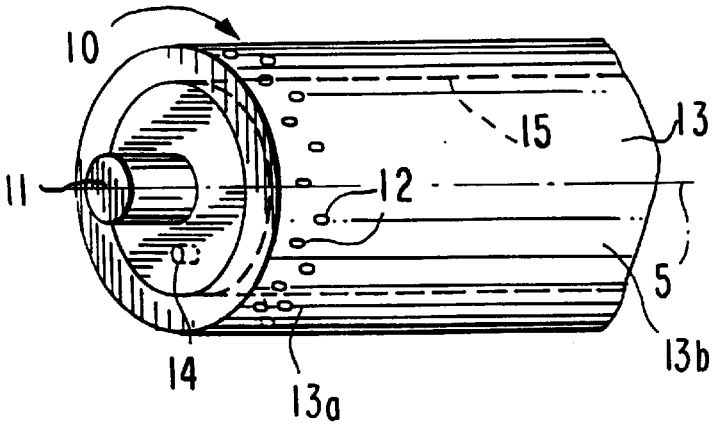
FIG. 1 is a perspective view of a cylinder adapted to create an air cushion for formation of a copper sleeve, used in the process in accordance with the present invention.

With reference to the drawings, a removable metal sleeve for printing machines, for rotogravure and/or flexographic printing for example, has been general identified by reference numeral 30.

This removable sleeve is preferably made of copper and photoengraving is generally carried out directly on this sleeve.

The copper sleeve is created on the cylinder 10 by immersion of the cylinder in a tank for electrolytic treatment and in more detail a tank for copper electroplating.

The cylinder 10, before being immersed in the electroplating tank 25, can be treated on its side surface with a separation product 20 to facilitate final release of the sleeve.

The engraved copper sleeve 30 can also be used for a new photoengraving by mechanically removing the engraved layer therefrom.

After formation of the copper sleeve according to an advantageous application of the process, the separation product 20 is applied again to the base formed by said sleeve and subsequently formation of a further copper coating is carried out on said base in the electroplating tank.

In this way, in order to carry out a new engraving, the copper coating is removed from the sleeve, also with use of mechanical means.

It is thus possible, by interposition of a separation product 20, to form a new coating for a new photoengraving in the electroplating tank.

The separation product used is preferably an aqueous solution of silver salts.

This aqueous solution of silver salts is the one resulting from the by-then exhausted solution used as fixing agent for a photographic film in the photoengraving process of the copper sleeve, charged with silver salts that have not been blackened by the photographic development and that have been removed during the fixing operation.

Advantageously the cylinder has a device capable of creating an air cushion to facilitate sliding of the sleeve on separation from the cylinder itself.

In particular, as shown in FIG. 1, the cylinder 10 arranged to be used for manufacturing metal sleeves intended for printing has a cavity 15 at the inside thereof, which is provided with at least one inlet 14 to allow admission of a fluid under pressure (clearly the utilized fluid advantageously appears to be air) and a predetermined number of outlet holes 12 disposed on the side surface 13 of the cylinder 10.

Preferably cavity 15 will only concern a small side volume at the outlet holes in order to avoid too many working operations on the cylinder; at all events the shape and sizes of such a cavity are not of importance for the purposes of the invention.

As can be viewed still from FIG. 1, the outlet holes 12 are disposed at a side edge portion 13*a* of the cylinder 10. Obviously these holes 12 can be provided both on a first end portion and the second end portion of the cylinder and at every point of the side surface not intended for receiving the metal sleeve. It is in fact apparent that, since electrodeposition takes place directly on the side surface 13 of the cylinder (possibly with interposition of the separation product), at the regions where the metal sleeve is intended to grow in a galvanic bath not even a little defect or surface discontinuity can be present because otherwise unevenness of the sleeve would occur, which will make the sleeve useless in printing processes. It is important that said defects be not present in the regions of the side surface where the true metal sleeve is wished to be made.

Therefore the cylinder 10 with pins 11 has small holes 12 on its side surface 13 which communicate with the inner cavity 15 provided with a side mouth 14 for compressed air admission, so as to create an air cushion when the copper sleeve to be formed around said cylinder s about to be removed.

Before carrying out immersion in the electroplating a tank to obtain the metal sleeve, in accordance with the method of the invention, appropriate protection means 2 for closing the outlet holes 12 is applied.

Obviously, use of this protection means aims at preventing some liquid of the electroplating bath from entering cavity 15 when the cylinder is immersed in said bath so that some copper particles will not deposit close to the holes thereby fully or partly closing the outlet ports of the holes themselves.

Figure 2:
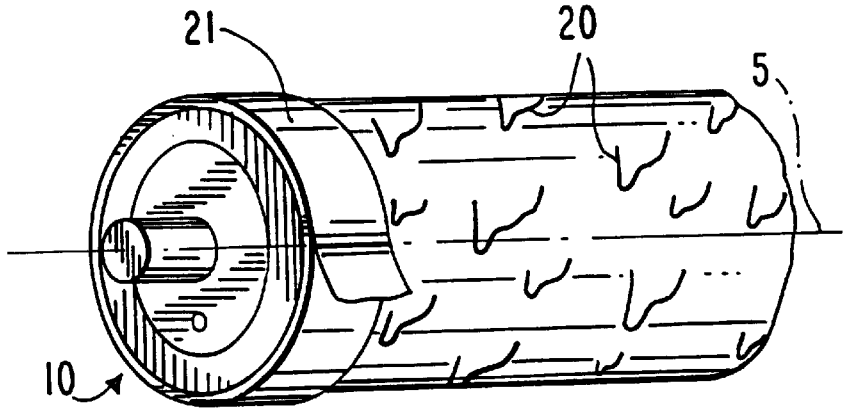
FIG. 2 shows the cylinder in FIG. 1 treated with a solution of a separation product and having protection means for hole closure applied thereto.

As already explained, the cylinder possibly treated with the solution 20 of a separation product as shown in FIG. 2 and after application of the protection means 2 defined in one embodiment by one or more non-conductive protective side bands 21 on the perforated region, is immersed in the liquid 26 in tank 25 for copper electroplating.

Figure 4:
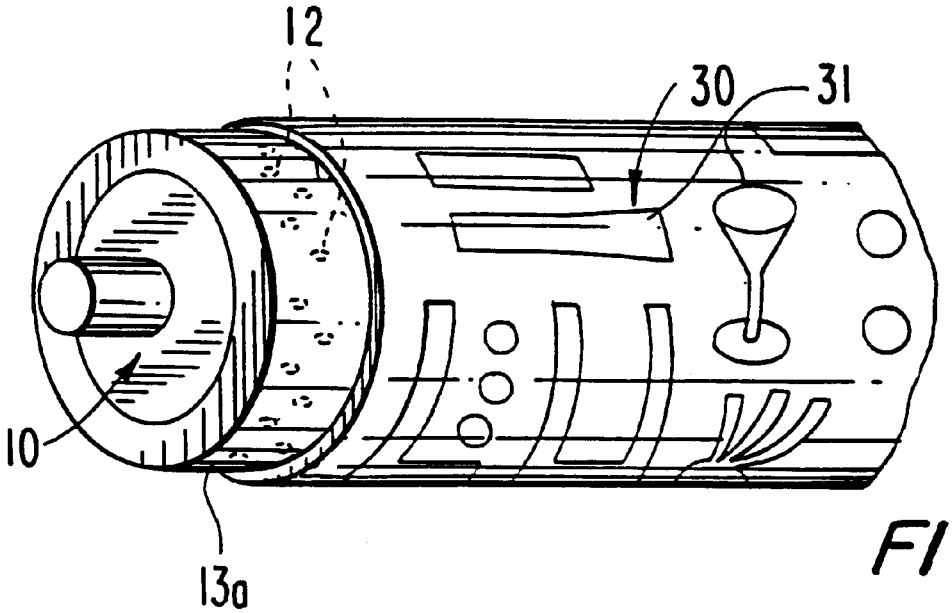
FIG. 4 shows the cylinder completed with a photoengraved copper sleeve.

When formation of the copper sleeve 30 has been completed, the cylinder is taken out to enable photoengraving of the image 31 as shown in FIG. 4.

In more detail, use of these side bands 21 preferably of an insulating material prevents copper or any possible metal giving origin to the removable sleeve in the electroplating bath from being electrodeposited on said bands.

Figure 3:
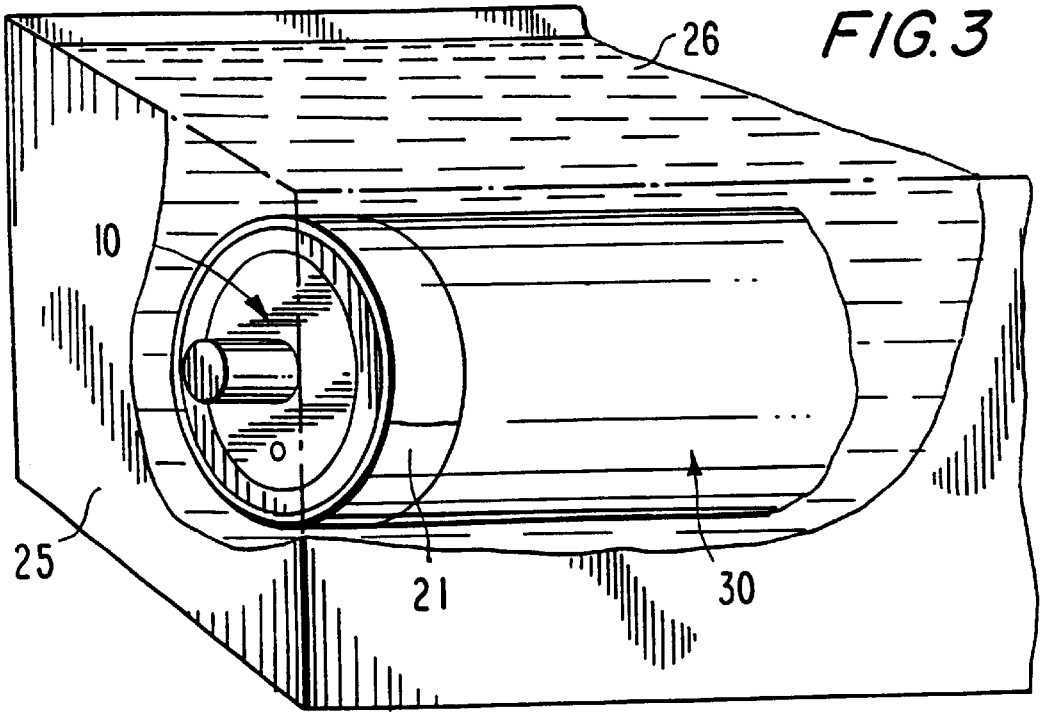
FIG. 3 shows the wet cylinder seen in FIG. 2 subsequently immersed in a tank for copper electroplating.

As shown in FIG. 3, sleeve 30 is formed on the side surface of cylinder 10 except for in correspondence of the bands 21.

After the cylinder has been drawn out, the further process step involves removal of such protective side bands 21 so that holes 12 for exit of the air under pressure are brought again to sight.

Figure 5:
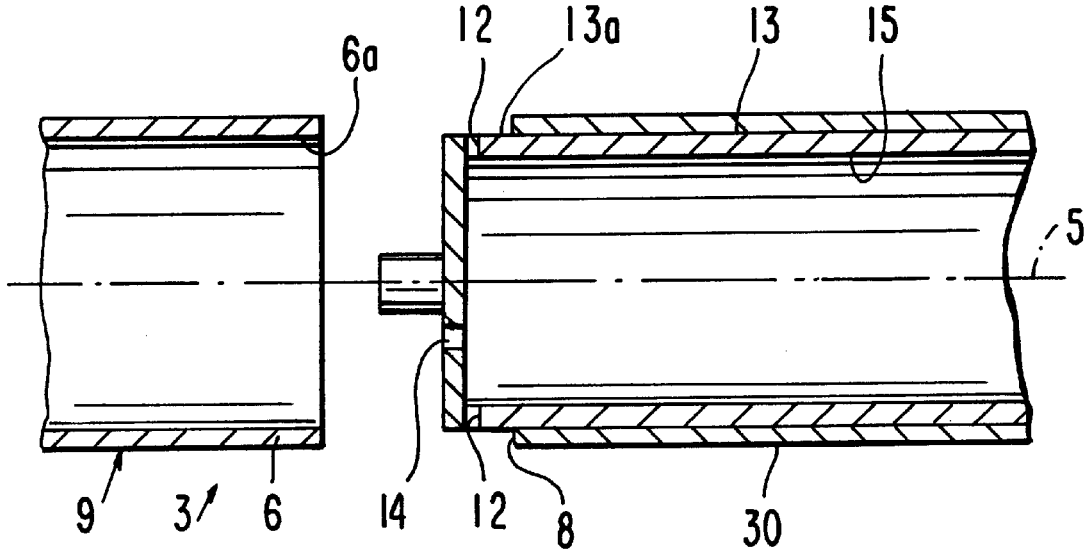
FIGS. 5 and 6 show two steps in succession for axial removal of the metal sleeve.
Figure 6:
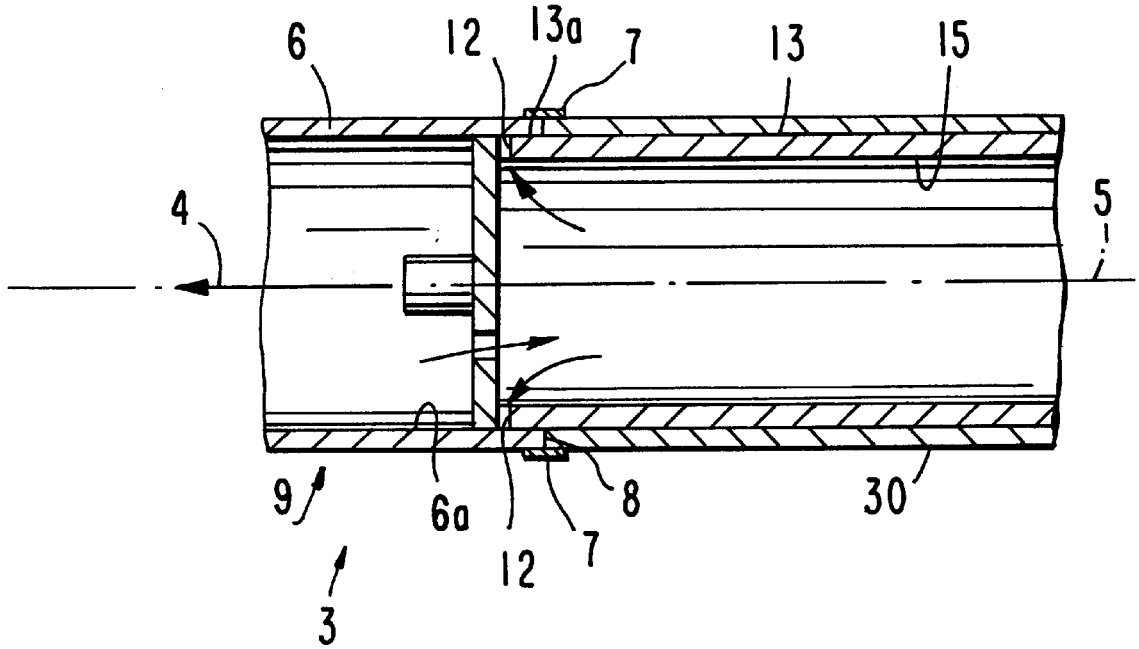
Figure 8:
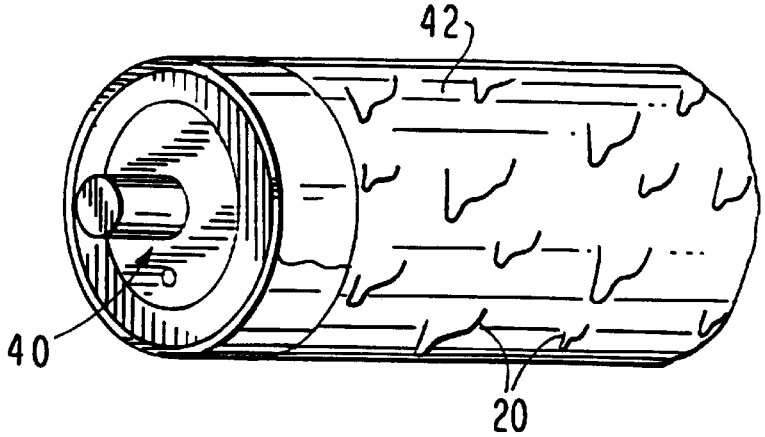
FIG. 8 shows the cylinder at the end of a copper electroplating layer, submitted to a new treatment with a separation product.

Under this situation, suitable extraction means 3 is provided at least close to said side edge portion 13*a* to enable extraction of the just formed sleeve (see in particular FIGS. 5 and 6).

As regards structure in particular, the extraction means 3 may consist of an appropriate tooling 9 to be inserted at least partly along an extraction direction 4 coincident with the axial extension 5 of the cylinder so that the compressed air outlet holes 12 are again covered.

For example use of a hollow covering element 6 may be provided, a hollow cylinder for example, the shape of the inner surface of which substantially matches that of the outer side surface 13 of the cylinder 10.

This cylindrical covering element 6 will be provided with at least one inner end surface 6*a* the shape of which matches that of the side edge portion 13*a* of the cylinder 10 that therefore, after the insertion step, will substantially cover holes 12 and match with, and abut against the final film of the metal sleeve 30 made by laterally bearing thereon.

For instance, the extraction tooling 9 used shall be a metal sleeve previously made with the same cylinder 10.

Under this situation, by substantially preventing passage of air between an end of the metal sleeve 30 disposed close to the outlet holes 12 and the extraction means 9, an air cushion will be generated at the region included between the whole side surface 13 of the cylinder 10 and the inner surface 6*a* of the covering element 6 and the copper sleeve 30.

To prevent air escape from the contact region or portion 8 of the metal sleeve 30 and the extraction tooling 9, at said contact region 8 use is provided of at least one auxiliary protective tape 7 or any other means suitable to prevent gas escape between the surfaces in mutual contact (see in particular FIGS. 5 and 6).

In an alternative embodiment, still in accordance with the present invention, for covering the outlet holes 12 provision may be made for winding of an element made of a conductive material such as metal in such a manner that in the electroplating bath the sleeve 30 is directly electrodeposited on the side surface 13*b* designed to receive it and also at such a metal element 16. In particular a ring may be used which is made of the same material as the removable sleeve for printing, in this particular case copper.

Figure 10:
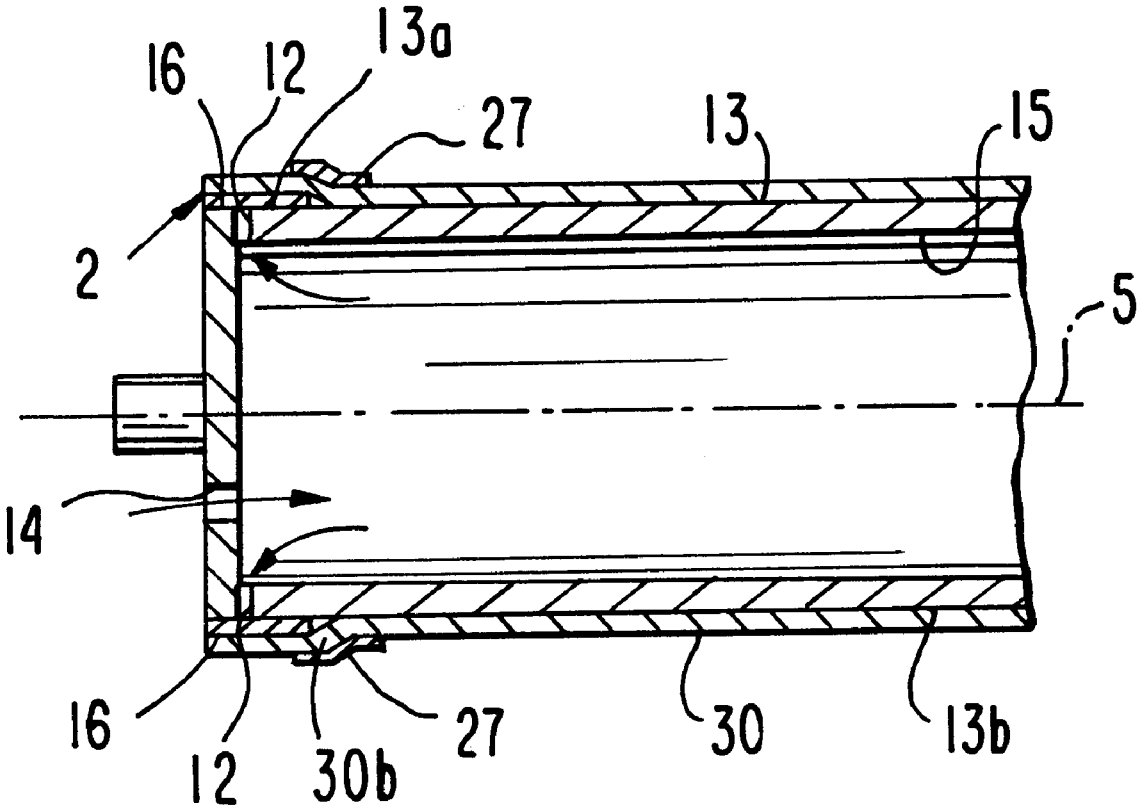
FIG. 10 is a diagrammatic longitudinal section view of a metal sleeve ready for removal using an alternative method in accordance with the present invention.

By applying this extraction tooling 9 for closure of holes 12 and immersing the cylinder 10 having its holes thus protected in the electroplating bath, deposition of copper particles will take place both on the side surface 13, thus forming the portion intended to constitute the metal sleeve 30 to be used for printing, and at the copper ring 16 and above the same, thereby forming a further portion intended to create a continuous single body around the cylinder the outer diameter of which will obviously be very uniform and precise at the central region 13*b* of the cylinder 10 and then will have a discontinuity region with increase in the radial sizes at the metal ring made of copper (see FIG. 10).

In particular, at the end of the growing process of sleeve 30 in a galvanic bath, the copper ring and the sleeve deposited thereon and on the cylinder 10 will form a single rigid body.

At this point air is directly blown in through holes 12, in this way causing creation of an air cushion interposed between the whole surface of cylinder 13, the copper ring 16 and the metal sleeve 30 so that extraction of said sleeve 30 can take place.

Figure 7:
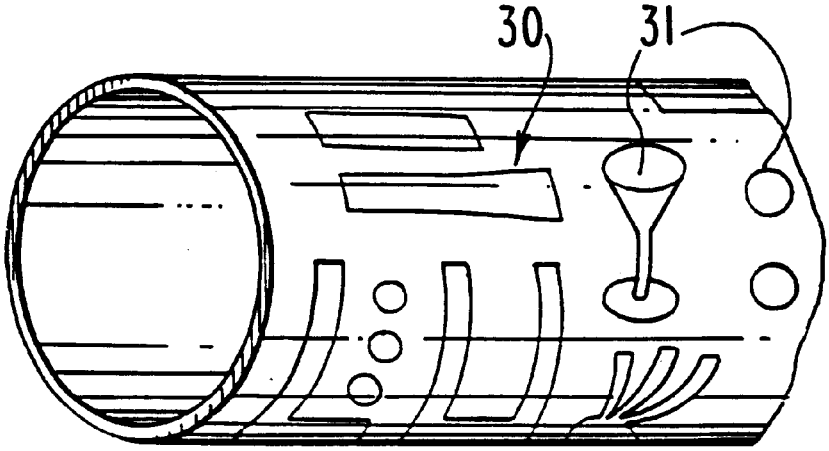
FIG. 7 shows the photoengraved sleeve removed from the cylinder.

Once it has been separated from cylinder 30, the metal sleeve is cut at its end carrying the copper ring, said end being discarded so that a sleeve to be used for printing, of the type shown in FIG. 7, is obtained.

It is apparent that the discontinuity portion located directly astride between the side surface 13 and the copper ring 16 will be sometimes weakened due to the copper electrodeposition which is not optimal because there is an uneven presence of electric discharges between the cylinder 10 and ring 16. It may be therefore advantageous for the discontinuity region 30*b* to be optionally reinforced by stiffening means 27 (see FIG. 10) before carrying out the air-insufflating and extraction operations.

For instance, application of an adhesive tape may be advantageous in order to prevent the pressure forces generated following compressed air emission through holes 12 from creating tensions in the metal sleeve, which are capable of breaking and separating the portion incorporating the copper ring from the rest of the sleeve, thereby inhibiting extraction of the latter.

Advantageously, the cylinder 10 generally made of iron may have, on its side surface, an added chromium layer suitably lapped and made smooth, i.e. without surface irregularities, to enable an easier separation of the copper sleeve therefrom.

Should the cylinder be made of steel, the thin chromium layer would be superfluous.

This chromium layer will be present at least on the whole region intended to receive the sleeve 30 and preferably over the whole side surface of the cylinder.

It is in fact known that the bond created during copper electrodeposition on a chromium surface is relatively weak and therefore facilitates the extraction operation of the electrodeposited sleeve.

An advantageous method of extraction of a copper-electroplated sleeve can be that of using a cylinder 10 provided with a side surface 13 made of suitably treated chromium and of causing extraction of the sleeve 30 copper-electroplated by a process in an electroplating tank, through generation, by mechanical means such as rollers, of a counter-rotation of the cylinder 10 with respect to the outer sleeve 30.

In particular, provision may be made for either driving the cylinder in rotation keeping the metal sleeve fixed in a static position or vice versa, or a combination of the motions of the two bodies to be separated, in a clockwise and counter-clockwise direction.

The relative movement may also be of the rotational-translational type in which translation will obviously take place along an axial removal direction 4 of the sleeve.

This extraction method possibly combined with either of the two previously described extraction methods of metal sleeves will enable an optimal, removal of the thus made copper sleeve.

With a facilitated action due to the possible presence of the separation product 20 and the air cushion created by the compressed air admitted to cavity 15, the photoengraved sleeve 30 is removed (FIG. 7) and then submitted to a protective chromium layer.

This sleeve is then sent to the rotogravure printworks to be mounted on the cylinders of the printing presses.

When the required press-run has been exhausted, this sleeve can be sent back to the firm carrying out photoengraving.

Depending on the sleeve thickness, this sleeve can be remelted or removal of the engraved layer in the form of a foil can be carried out; then a new copper plating and smoothing operation takes place followed by a new photoengraving for the new image required by the customer.

As an alternative to the described method, the sleeve can be obtained on a cylinder 40 from a copper layer 42 still with interposition of a separation product.

Figure 9:
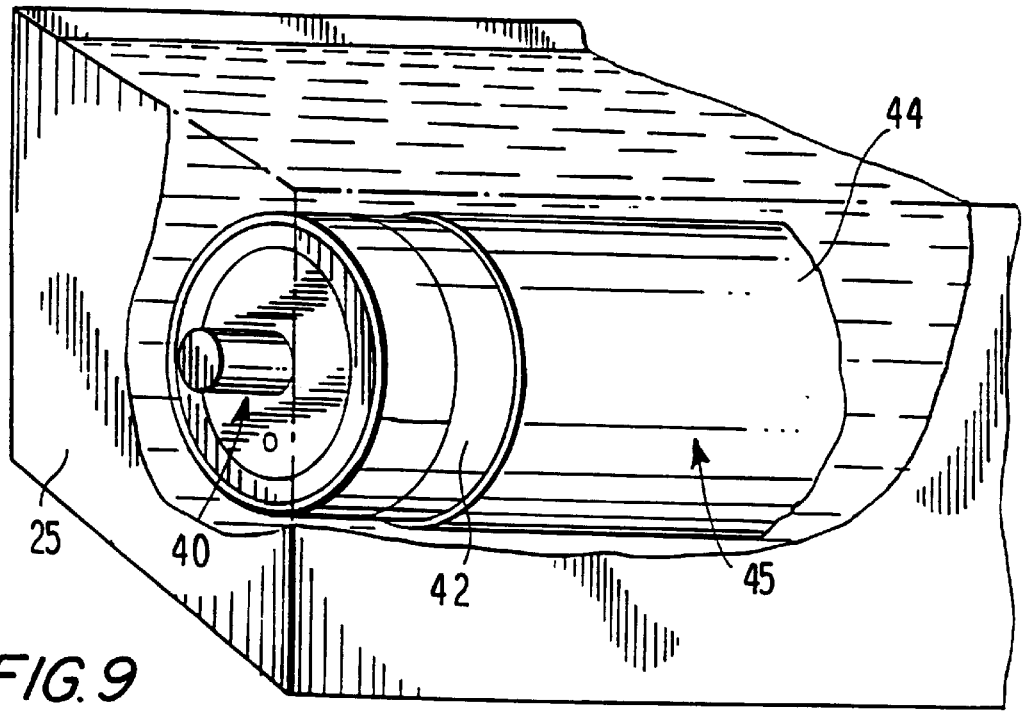
FIG. 9 shows the cylinder seen in FIG. 8 put into the copper plating tank again for formation of a copper coating at the end of this process.

The cylinder 40 is submitted to a new bath with a separation product 43 and again immersed in the copper plating tank 25 for formation of a copper coating 44 giving rise to a sleeve 45 (FIG. 9).

This coating is then photoengraved with the desired image 31, removed from the cylinder and after a protective chromium-based thin covering, sent to the printworks.

Figure 11:
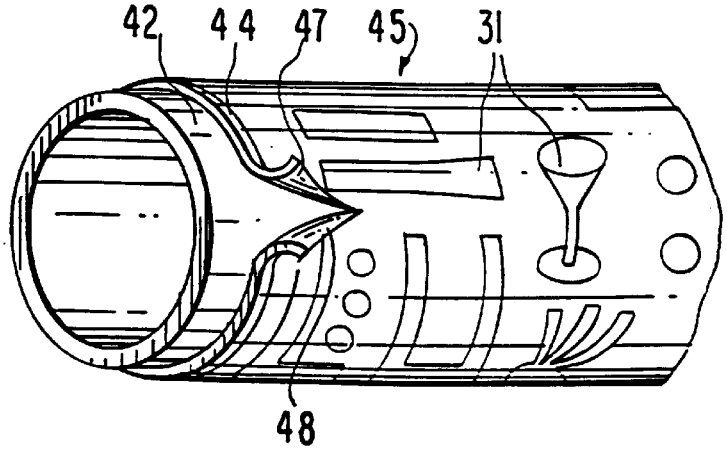
FIG. 11 shows a step of removing a metal coating electroplated on the copper sleeve.

When the desired press-run has been completed, the sleeve 45 is sent back to the engraver's shop that can carry out formation of a new image. The engraver separates the coating 44 from the cylinder 40 (this separating operation is also executable with mechanical means, as shown in FIG. 11 where the flaps 47, 48 of the coating 44, which are being detached, are visible).

When this operation is over, still with interposition of a separation product, formation of a new coating for a new photoengraving can be carried out.

A normal photoengraving activity comprises preparation of the photographic material to be engraved both by a chemical method and by an electromechanical method. As the fixing agent for the photographic film, different solutions are used which for example contain: sodium thiosulfate or hypo, bisulfite, ammonia thiosulfate.

These solutions remove the non-oxidized silver salts from the photographic development. When this solution is exhausted, it is rich in silver salts and therefore it is recycled in the engraver's shop, being used as an appropriate separation product both between the cylinder and copper sleeves and between he copper coating and the copper layer in the form of a film, should sleeves include such a layer and coating.

In a further alternative embodiment, provision is made for use of protection means 2 defined by screws inserted in holes 12 before the electroplating bath can be provided, although this means is more complicated and expensive. The number of these screws obviously will be the same as that of the holes and the screws will be inserted from the inside of cavity 15 towards the outside, so that the base surface of the threaded stem may take place flush with the side surface 13 of the cylinder. In this way sleeve 30 is deposited over the whole side surface 13 of the cylinder, over the holes as well.

Once the cylinder has been taken out of the tank, the screws are removed from the inside and then by blowing in air through the holes an air cushion is produced between the sleeve and the cylinder, which will enable an easy separation of them.

The invention achieves important advantages.

Elimination of the nickel base and the copper film, by replacing this base with a sleeve directly made of copper, not only gives rise to a drastic saving in the material cost but also makes the working time shorter and the working operations less complicated.

Direct photoengraving on the sleeve completely made of copper is much simpler and quicker.

If a copper coating is formed on the copper base by interposition of a separation product, further advantages are achieved, since removal of the copper coating at each new photoengraving is simple and quick.

As regards the advantages offered by the removable sleeves as compared with the directly photoengraved cylinders, they are greatly increased not only in terms of costs but also in terms of quickness and simplicity in operation.

Finally, use of a cylinder with a chromium layer enables a simpler and more efficient removal, which will greatly reduce the efforts and deformations generated on the sleeve during the delicate removal step.

What is claimed is:

1. A process for preparing removable sleeves to be photoengraved for printing presses, comprising the following steps:

setting a cylinder (10) having an inner cavity (15) provided with at least one inlet (14) to enable passage of fluid under pressure towards the inner cavity (15) and a given number of outlet holes (12) in communication with the inner cavity (15), said outlet holes (12) being disposed at a side surface (13) of said cylinder (10);

associating protection means (2) for closure of the outlet holes (12) of the cylinder (10), said holes (12) being disposed on at least one side edge portion (13*a*) of the side surface (13) of the cylinder (10), immersing the cylinder (10) with said protection means (2) for closing said outlet holes (12) in an electroplating bath;

forming a metal sleeve (30) directly on the side surface (13) of the cylinder (10), said outlet holes (12) being not present in a region (13*b*) of the side surface (13) arranged to receive the metal sleeve (30);

taking the cylinder (10) out of the electroplating bath;

positioning extraction means (9) at least at said side edge portion (13*a*) provided with outlet holes (12);

substantially preventing passage of fluid between the extraction means (9) and an end of the metal sleeve (30) disposed at the region of the outlet holes (12);

blowing in a fluid under pressure inside the cavity (15) through said inlet (14) to generate a corresponding fluid flow through said outlet holes (12), said extraction means (9) urging the fluid to form an air cushion between the metal sleeve (30) and the side surface of the cylinder (13); and axially removing the metal sleeve (30) and the extraction means (9) from the cylinder.

2. The process as claimed in claim 1, further comprising the step of treating the side surface (13) of the cylinder (10) with a separation product (20) prior to the step of immersing the cylinder (10) in the electroplating bath.

3. The process as claimed in claim 1, wherein said step of positioning extraction means (9) comprises the sub-steps of inserting the extraction means (9) at least partly along a direction (4) coincident with an axial extension (5) of the cylinder (10) and cover said outlet holes (12) with said extraction means (9), said extraction means (9) comprising a hollow covering element (6) having at least one inner end surface (6*a*) the shape of which substantially matches that of the side edge portion (13*a*) of the cylinder (10) carrying the outlet holes (12).

4. The process as claimed in claim 1, wherein said step of substantially preventing fluid passage comprises the sub-step of associating at least one auxiliary protective tape (7) at a contact portion (8) of said extraction means (9) and said electrodeposited metal sleeve (30).

5. The process as claimed in claim 1, further comprising the step of removing said protection means (2) for closing the outlet holes (12) after the step of extracting the cylinder (10) from the electroplating bath.

6. A process for preparing removable sleeves to be photoengraved for printing presses comprising the following steps:

setting a cylinder (10) having an inner cavity (15) provided with at least one inlet (14) to enable passage of fluid under pressure towards the inner cavity (15) and a given number of outlet holes (12) in communication with the inner cavity (15), said outlet holes (12) being disposed at a side surface (13) of said cylinder (10);

associating protection means (2) for closure of the outlet holes (12) of the cylinder (10), said holes (12) being disposed on at least one side edge portion (13*a*) of the side surface (13) of the cylinder (10), immersing the cylinder (10) with said protection means (2) for closing said outlet holes (12), in an electroplating bath;

forming a metal sleeve (30) directly on the side surface (13) of the cylinder (10) and on an outer surface of said protection means (2), said metal sleeve (30) continuously covering the side surface (13) of the cylinder (10) and the outer surface of the protection means (2);

taking the cylinder (10) out of the electroplating bath;

blowing in a fluid under pressure inside the cavity (15) to obtain a corresponding flow through said outlet holes (12);

urging the fluid between an inner surface of the protection means (2) and the side surface (13) of the cylinder (10) to form an air cushion between said inner surface of the protection means (2) and the side surface (13) of the cylinder (10) and between the metal sleeve (30) and the side surface (13) of the cylinder (10);

axially removing the metal sleeve (30) from the cylinder.

7. The process as claimed in claim 6, wherein said step of forming a metal sleeve (30) comprises a sub-step of forming, during electroplating in a tank, a discontinuity region (30*b*) at a discontinuity present between the side surface (13) of the cylinder (10) and the protection means (2), and wherein said process further comprises a step of associating stiffening means (27) with an outer surface of the metal sleeve (30) and at least at the discontinuity region (30*b*).

8. The process as claimed in claim 6, further comprising the step of treating the side surface (13) of the cylinder (10) with a separation product (20).

9. A process for preparing removable sleeves to be photoengraved for printing presses comprising the following steps:

preparing a cylinder (10) having a side surface (13) at least partly covered with a thin layer of chromium;

immersing the cylinder (10) in a copper electroplating bath;

forming a copper sleeve (30) directly on the side surface (13) of the cylinder (10), the side surface (13) that receives the electrodeposition being fully covered with said thin layer of chromium;

taking the cylinder (10) out of the copper electroplating bath;

after said step of taking the cylinder (10) out of the copper electroplating bath moving the copper sleeve (30) with respect to the cylinder (10) in an at least partly rotary motion around an axis coincident with a longitudinal extension axis (5) of said cylinder (10);

axially removing the copper sleeve (30) from the cylinder (10).

10. The process as claimed in claim 9, further comprising the step of treating the side surface (13) of the cylinder (10) with a separation product (20) prior to the step of immersing the cylinder (10) in the electroplating bath.

11. The process as claimed in claim 10, further comprising the steps of:

treating an outer surface of the copper sleeve (30) with a second separation product (20);

immersing said cylinder (10) carrying the removable metal sleeve (30) with the second separation product (20) in a copper-electroplating bath;

forming a metal film (44) made of copper over said metal sleeve (30), the separation products being interposed between the metal film (44) and the metal sleeve (30) and between said sleeve (30) and the cylinder (10).

12. The process as claimed in claim 11, further comprising the step of mechanically removing the metal film (44) from the metal sleeve (30).

13. The process as claimed in claim 9, wherein the step of preparing the cylinder (10) comprises the sub-steps of:

setting a cylinder (10) having an inner cavity (15) provided with an inlet (14) to enable passage of fluid under pressure towards the inner cavity (15) and a given number of outlet holes (12) in communication with the inner cavity (15);

associating protection means (2) for closure of the outlet holes (12) of the cylinder (10), said outlet holes (12) being disposed on at least one side edge portion (13*a*) of the side surface (13) of the cylinder (10).

14. The process as claimed in claim 13, wherein the step of forming a copper sleeve (30) on the side surface (13) of the cylinder (10) comprises the sub-step of forming said sleeve (30) also on an outer surface of said protection means (2), said metal sleeve (30) continuously covering the side surface (13) of the cylinder (10) and the outer surface of the protection means (2); and wherein said process further comprises the steps of:

blowing in fluid under pressure inside the cavity (15) to obtain a corresponding flow through said outlet holes (12); and urging the fluid between an inner surface of the protection means (2) and the side surface (13) of the cylinder (10) to form an air cushion between the inner surface of the protection means (2) and the side surface (13) of the cylinder (10) and between the metal sleeve (30) and the side surface (13) of the cylinder (10).

15. The process as claimed in claim 13, further comprising the steps of:

positioning extraction means (9) at least at said one side edge portion (13*a*) provided with the outlet holes (12);

substantially preventing fluid passage between the extraction means (9) and an end (8) of the metal sleeve (30) disposed at the outlet holes (12);

blowing in a fluid under pressure inside the cavity (15) through the inlet (14) to generate a corresponding fluid flow through said outlet holes (12), said extraction means (9) urging the fluid to form an air cushion between the metal sleeve (20) and the side surface (13) of the cylinder (10).

* * * * *